United States Patent [19]

Seidel

[11] 4,042,897

[45] Aug. 16, 1977

[54] A-C MAGNET WITH A SHORTING RING

[75] Inventor: Siegfried Seidel, Amberg, Germany

[73] Assignee: Siemens Aktiengesellschaft, Munich, Germany

[21] Appl. No.: 577,872

[22] Filed: May 15, 1975

[30] Foreign Application Priority Data

May 22, 1974 Germany ..... 2424983

[51] Int. Cl.[2] ..... H01F 7/10; H01F 7/12

[52] U.S. Cl. ..... 335/245; 335/247

[58] Field of Search ..... 335/245, 104, 247; 317/156; 310/172; 336/197; 29/602

[56] References Cited

U.S. PATENT DOCUMENTS

| | | | |
|---|---|---|---|
| 3,283,275 | 11/1966 | Rider, Jr. | 335/245 |

FOREIGN PATENT DOCUMENTS

| | | | |
|---|---|---|---|
| 739,507 | 9/1943 | Germany | 335/245 |
| 1,489,806 | 2/1970 | Germany | 335/245 |
| 663,737 | 12/1951 | United Kingdom | 335/245 |

*Primary Examiner*—Harold Broome

*Attorney, Agent, or Firm*—Kenyon & Kenyon, Reilly, Carr & Chapin

[57] ABSTRACT

In an a-c magnet in which slots are provided which run transversely to the direction of the laminations in the surface of at least one pole and in which a shorting ring is arranged with its long sides in the slots, the slots are caused to have mortized edges so that each long side of the spring is pushed on both sides toward the bottom of the slot. The shorting ring is thus caused to reliably rest at the bottom of the slot, and loosening and vibration of the shorting ring are thereby prevented.

4 Claims, 7 Drawing Figures

A-C MAGNET WITH A SHORTING RING

BACKGROUND OF THE INVENTION

1. Field of the Invention

The present invention concerns an a-c magnet and, in particular, an a-c magnet having slots running transversely to the direction of the laminations in the surface of at least one pole and including a shorting ring arranged with its long edges in the slots.

2. Description of the Prior Art

In one known a-c magnet of the above-mentioned kind, the shorting ring is first placed in slots in the magnet. A calking tool is then set along the top side of the ring in the vicinity of the slots, and, simultaneously, a stamping tool is set along the outside of the parts of the walls which extend beyond the ring. The ring is then secured to the magnet by bending the wall parts in the direction toward the slots. During such action, the calking tool serves as a hold-down mechanism, thereby preventing the ring material from escaping outward when the wall sections are bent. With this technique, the hold-down force exerted by calking tool must be of such a magnitude as to cause the shorting ring to be deformed, otherwise the shorting ring will not rest on the slot bottom and will loosen and vibrate. In addition, using this technique the pole surface is altered by the bending of the wall parts, thereby necessitating an additional grinding operation in order to obtain a flat seating surface.

In another known technique, the shorting rings of an a-c magnet are secured in two slots whose vertical center lines intersect at least once, by elastic or plastic deformation. This technique requires the use of expensive stamping tools, and, moreover, presents problems for smaller cross sections as, in order to secure the ring, a certain amount of shorting ring material must be deformed.

It is an object of the present invention to provide an a-c magnet whose shorting ring is secured in a simple manner.

SUMMARY OF THE INVENTION

The present invention is based on the realization that a point-wise and partial connection between an a-c magnet and a shorting ring is disadvantageous since such a connection leads to the existence of freely vibrating residual masses which are subject to the danger of fatigue fracture, and, furthermore, to local stresses which additionally trigger harmful notch effects. More particularly, in accord with the present invention, an a-c magnet of the above-mentioned kind is modified by forming the slots holding the long sides of the shorting ring so their edges are mortized. By forming the edges in this manner, the sides of the ring are pushed on each side toward the bottom of the slot, thereby ensuring the presence of vertical forces to force the shorting ring to rest tightly against such bottom. Advantageously, the slots may be formed in a trapezoidal configuration to facilitate securing of the ring.

Additionally, in order to further secure the sides of the shorting ring transverse to its long sides, it is advantageous to rest these transversal sides at least partly on a transversal area corresponding to the bottom of the slot and the inner edges of the slot which are pushed at least partially in the direction toward this transversal area. Also, it is a further advantage if the shorting ring has the edges of its long sides chamfered.

In accord with the invention, a device is also provided for attaching the shorting ring to the magnet which comprises for each long side of the shorting ring a press which has a stamp which pushes down on the pole surface areas defining the slot edge adjacent the respective long side. The individual stamps of the device can also be combined by providing that the a-c magnet part is properly supported in the press. Moreover, if the edges of long sides of the shorting ring are chamfered, it is advantageous to form the stamps as hollow cylindrical members in the region of the long sides.

In another aspect of the invention, if a low specific load on the magnet is desired in production, a method for inserting the shorting ring has been found advantageous in which the placing of the shorting rings in the slots and the pushing down the areas of the pole surfaces which are adjacent to the long sides of the shorting ring are carried out by roller-embossing.

BRIEF DESCRIPTION OF THE DRAWING

Illustrative embodiments of the present invention will be described in the following detailed description which makes reference to the accompanying drawings, in which.

DETAILED DESCRIPTION

It should be noted that the same parts have been labelled with the same reference symbols in all figures.

Figure 1:
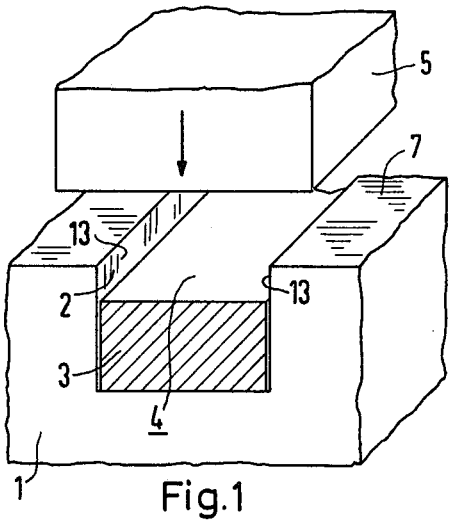
FIG. 1 shows part of the pole of an a-c magnet which is to be formed in accordance with the invention.
Figure 2:
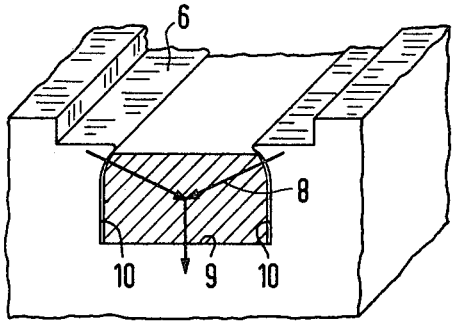
FIG. 2 illustrates the pole part of FIG. 1 after it has been formed by a stamp of a press.

The pole 1 shown in FIG. 1 is part of a laminated a-c magnet and has a slot 2 in which the long side 3 of a shorting ring 4 is placed. A stamp 5 co-extensive with the long side 3 serves to mortize the edges of the slot running along the side 3, thereby mortizing the shorting ring 2 in the slot. After the mortizing operation, the areas 6 of the surface 7 of the pole 1 adjacent to the long sides 3 of the shorting ring are as shown in FIG. 2. As can be appreciated, the mortized form of these areas establishes a force diagram as illustrated by the reference symbol 8. This diagram shows clearly that the mortized slot edges result in lateral components which produce a vertical force which causes the shorting ring to rest flush against the slot bottom 9. As shown, the side walls 10 of the slot 2 may be positioned separated from the shorting ring itself in the area of the slot bottom.

Figure 3:
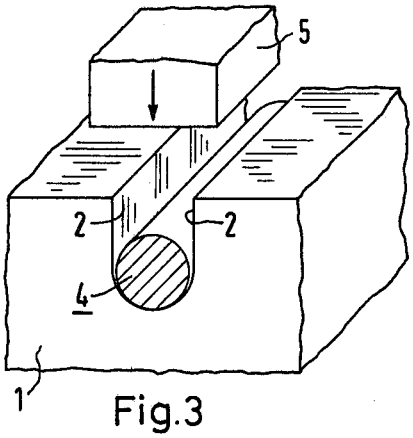
FIGS. 3 and 4 show similar views as those of FIGS. 1 and 2 for a pole part having a semi-circular slot for receiving a shorting ring of circular cross section.
Figure 4:
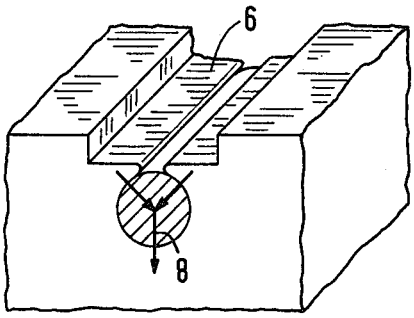
Figure 5:
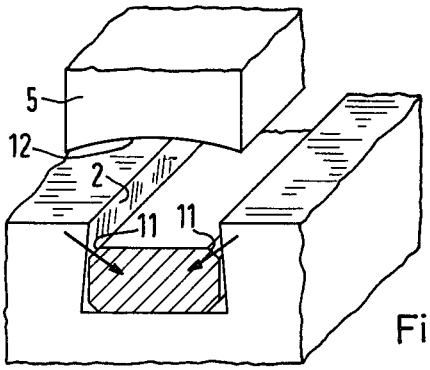
FIG. 5 shows a pole part to be formed in accord with the invention in which a shorting ring with sheared-off edges is placed in a trapezoidal slot of the pole part.

In FIGS. 3 and 4, the shorting ring 4 has a circular cross section and the slot 2 is appropriately shaped to receive such a cross section. In FIG. 5, the slot 2 is illustrated as having a trapezoidal shape and the edges 11 of the long sides 3 and the transversal sides 14 of the shorting ring 4 are illustrated as being chamfered. Moreover, in FIG. 5 the stamp 5 is shown as having a cylindrical cavity 12 which results, after stamping, in an increased vertical component for pushing the shorting ring against the slot bottom 9 over that realized in the embodiments of FIGS. 1 to 4.

Figure 6:
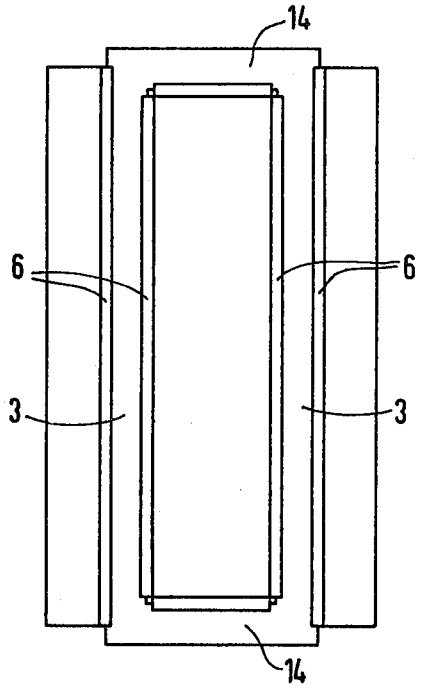
FIG. 6 illustrates the top view of a pole with a shorting ring attached therein in accordance with the invention, wherein the sides of the shorting ring transverse to its long side have been pushed onto the bottom of the pole slot by one sided stamping.

In FIG. 6 is shown a top view of a pole having a shorting ring secured therein along its long sides 3 by mortized areas 6, and along its sides 14 transverse to its long sides by areas mortized along the inner slot edge.

Figure 7:
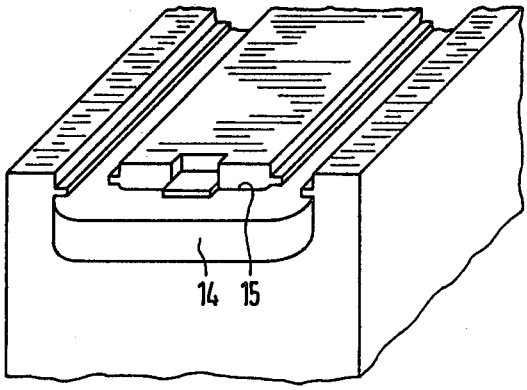
FIG. 7 shows a perspective view of the embodiment according to FIG. 6 with a partially stamped transversal side.

In FIG. 7, a transversal area 15 corresponding to the slot bottom is provided to serve as a seat for the transversal side 14 of a shorting ring.

As can be appreciated from the above, the mortizing operation according to the invention produces a component which pushes the shorting ring into the bottom of the magnet slot and, thus, eliminates the necessity of having to hold the spring down as was the case in prior arrangements.

What is claimed is:

1. An a-c magnet including at least one pole comprised of laminations and having first and second slots running transversely to said laminations, each of said slots opening onto the upper surface of said pole and being defined by opposing side walls extending downwardly from said upper surface; a shorting ring having longitudinally extending first and second long sides arranged in said first and second slots; said upper surface having depressions therein extending from and running along the length of the edges of each of said first and second slots whereby said sidewalls defining said first and second slots, respectively, are caused to exert downward forces on said first and second long sides of said ring which push said ring toward the bottom of said slots.

2. An a-c magnet in accordance with claim 1 in which said slots have a trapezoidal shape.

3. An a-c magnet in accordance with claim 1 in which the sides of said spring transverse to said long sides are seated at least partially on transversal areas extending between the bottoms of said slots and from whose inner edges sidewalls extend upwardly and at least partially toward said areas.

4. An a-c magnet in accordance with claim 1 in which said long sides have chamfered edges.

* * * * *